US011117386B2

(12) United States Patent
Ludgate et al.

(10) Patent No.: US 11,117,386 B2
(45) Date of Patent: Sep. 14, 2021

(54) INK RESERVOIR WITH PNEUMATICALLY DRIVEN INTEGRATED PISTON AND SHUT-OFF VALVES

(71) Applicant: Xerox Corporation, Norwalk, CT (US)

(72) Inventors: Gregory A. Ludgate, Williamson, NY (US); Timothy G. Shelhart, West Henrietta, NY (US); Michael J. Severn, Brockport, NY (US); Richard P. Ficarra, Williamson, NY (US); Dale T. Platteter, Fairport, NY (US); Victoria L. Warner, Caledonia, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/705,296

(22) Filed: Dec. 6, 2019

(65) Prior Publication Data

US 2021/0170760 A1 Jun. 10, 2021

(51) Int. Cl.
*B41J 2/175* (2006.01)

(52) U.S. Cl.
CPC ..... *B41J 2/17596* (2013.01); *B41J 2/17593* (2013.01)

(58) Field of Classification Search
CPC ..... B41J 2/17596
See application file for complete search history.

(56) References Cited

U.S. PATENT DOCUMENTS 2,830,743 A 4/1958 Rimsha et al.
3,204,832 A 9/1965 Morgan
4,520,369 A * 5/1985 Shackleton ..... B41J 2/17596 347/85
5,361,805 A 11/1994 Mayeux
6,692,117 B1 2/2004 Kamp
7,029,094 B2 4/2006 Nakamura
7,416,292 B2 8/2008 Leighton
7,883,198 B2 2/2011 McCracken et al.
8,303,098 B2 11/2012 Leighton et al.
8,529,030 B2 9/2013 McCracken et al.
10,272,690 B2 4/2019 Cameo Salinas et al.
2001/0020970 A1* 9/2001 Kuribayashi ..... B41J 2/175 347/85
2009/0260691 A1* 10/2009 Herman ..... B41J 2/175 137/12
2010/0156970 A1* 6/2010 Ikushima ..... B41J 2/04581 347/8

FOREIGN PATENT DOCUMENTS

KR 20050075299 A 7/2005

* cited by examiner

*Primary Examiner* — Shelby L Fidler
(74) *Attorney, Agent, or Firm* — Gibb & Riley, LLC

(57) ABSTRACT

An inlet seal, an outlet seal, and a piston are connected to a shaft. The inlet seal seals an ink inlet of an ink reservoir. The outlet seal seals an ink outlet of the ink reservoir. Also, the piston is within a cylinder. The inlet seal, the outlet seal, and the piston all move with the shaft. A biasing member contacts the piston to bias the piston in a first direction. Pressurized air simultaneously provided to the cylinder and to the ink reservoir biases the piston in a second direction, opposite the first direction, and pressurizes ink within the ink reservoir. Moving the shaft in the first direction does not seal the ink inlet but does seal the ink outlet. Moving the shaft in the second direction seals the ink inlet but does not seal the ink outlet, thus allowing the pressurized ink out from the ink reservoir.

20 Claims, 5 Drawing Sheets

INK RESERVOIR WITH PNEUMATICALLY DRIVEN INTEGRATED PISTON AND SHUT-OFF VALVES

BACKGROUND

Systems and methods herein generally relate to liquid ink printing devices that utilize pressurized ink reservoirs.

Printers that utilize liquid ink (e.g., inkjet printers, etc.) feed the ink in liquid form to the printheads. In one example, inkjet printers use printheads to jet ink onto a printing media substrate. Ink level sensors within the printheads identify when the ink level is low. When a low ink situation occurs in a printhead, ink from a reservoir tank can be flowed into the printhead under pressure. There are many ways to feed liquid ink into a printhead from a reservoir (e.g., liquid pumps, air pressure pumps, gravity feed, etc.). Also, these devices use structures (e.g., valves) to stop the liquid ink flow once the printhead and/or reservoir is replenished, to prevent over-filling (which can cause overflowing, mixing of different ink colors, etc.), and to prevent backpressure when the printhead is pressurized for a stale ink purge.

Sometimes the ink is not stored in a liquid form, but instead is stored in a solid (meltable) form. In other situations, it can be advantageous to raise the temperature of relatively cooler liquid ink to promote effective ink flow for printing, promote quick drying, etc. Therefore, some printers utilize what is commonly referred to as a "melter" device that includes a tank that is heated and potentially pressurized. For example, solid or semi-solid ink may be supplied to the melter, the melter may heat the somewhat solid form of ink into an appropriately temperature liquid, and the liquid ink can be stored (potentially under pressure) to be delivered as pressurized ink to the printheads.

In order to stop the liquid ink flow once the printhead and/or reservoir is replenished, melter devices include various shut-off valves. For example, a melter can include a shut-off valve to close the melter tank inlet, so that the internal tank can be pressurized, to enable ink flow to printhead (printhead). The melter tank can also include a separate shut-off valve that is separately controlled to close the melter tank outlet so as to prevent backflow when the printhead is pressurized for purge.

Valves used with melter devices are preferably items that have a low cost, have a very small footprint, limit the introduction of contaminants, are materially compatible with the ink, and are able to work in a hot, pressurized environment. Several types of valves are readily available, but some have limitations such as requiring direct human interaction to open or close the valve, some have a large footprint, some may not be able to operate in a high temperature environment, some may be expensive, some may introduce contaminants to the ink, etc. Therefore, improvements to the valves utilized with melter devices would be advantageous.

SUMMARY

Some examples of pressurized ink delivery apparatuses herein include an internal ink reservoir, an ink inlet positioned to allow ink to flow from an ink storage vessel into the internal ink reservoir, and an ink outlet positioned to allow ink to flow from the internal ink reservoir out to inkjet printheads. A reservoir air inlet is positioned to allow pressurized air to flow into the internal ink reservoir, and the pressurized air pressurizes ink in the ink reservoir.

Also, a pneumatic integrated multi-valve structure is positioned within the ink inlet and the ink outlet. The pneumatic integrated multi-valve structure is also positioned in a cylinder. A cylinder air inlet is positioned to allow pressurized air to flow into a first portion of the cylinder, and a biasing member is within a second portion of the cylinder.

In greater detail, the pneumatic integrated multi-valve structure has a shaft, an inlet seal connected to the shaft, an outlet seal connected to the shaft, and a piston connected to the shaft. The inlet seal, the outlet seal, and the piston are connected to the shaft and all move together with the shaft. The inlet seal, the outlet seal, and the piston are aligned relative to a centerline of the shaft. A piston seal seals the space between the piston and the cylinder. Also, a heater is positioned to heat the internal ink reservoir.

More specifically, the internal ink reservoir and the cylinder are separate cavities within a solid, continuous body. The body also has a linear shaft cavity in which the shaft is located. A first end of the linear shaft cavity is in fluid communication with the ink inlet and the internal ink reservoir. A second end of the linear shaft cavity is in fluid communication with the ink outlet and internal ink reservoir. This pneumatic integrated multi-valve structure has a shaft cavity seal between the first end of the linear shaft cavity and the second end of the linear shaft cavity, preventing fluid from passing through the linear shaft cavity between the first end and the second end.

The biasing member contacts the piston and biases the piston in a first direction, and pressurized air in the first portion of the cylinder biases the piston in a second direction, opposite the first direction. The reservoir air inlet and the cylinder air inlet are connected to the same air pressure source and receive the pressurized air simultaneously.

The shaft is adapted to move to a first position when biased by the biasing member in the first direction, and to a second position when biased by the pressurized air in the second direction. Positioning the shaft in the first position locates the inlet seal to not seal the ink inlet and simultaneously positions the outlet seal to seal the ink outlet. In contrast, positioning the shaft in the second position locates the inlet seal to seal the ink inlet and simultaneously positions the outlet seal to not seal the ink outlet. Closure of the ink inlet by the inlet seal prevents pressurized ink within internal ink reservoir from flowing out the ink inlet.

Such structures permit various methods including methods of delivering pressurized, heated ink. For example, such methods can provide a shaft, an inlet seal connected to the shaft, an outlet seal connected to the shaft, and a piston connected to the shaft. The inlet seal, the outlet seal, and the piston are positioned to be aligned relative to a centerline of the shaft.

The inlet seal seals an ink inlet that is in fluid communication with an ink reservoir. The outlet seal seals an ink outlet that is in fluid communication with the ink reservoir. Such methods locate the piston within a cylinder. Methods herein move the inlet seal, the outlet seal, and the piston (that are connected to the shaft) with the shaft. These methods also seal the space between the piston and the cylinder using a piston seal. Also, these methods heat the internal ink reservoir using a heater.

The shaft is within a body. The ink reservoir and the cylinder are separate cavities within the body. The body has a linear shaft cavity in which the shaft is located. A first end of the linear shaft cavity is in fluid communication with the ink inlet and the ink reservoir. A second end of the linear shaft cavity is in fluid communication with the ink outlet and ink reservoir. The methods herein prevent fluid from passing through the linear shaft cavity between the first end and the second end using a shaft cavity seal between the first end of the linear shaft cavity and the second end of the linear shaft cavity.

These methods also contact a biasing member against the piston to bias the piston in a first direction. Further, such methods simultaneously provide pressurized air to the cylinder and to the ink reservoir to bias the piston in a second direction, opposite the first direction, and to pressurize ink within the ink reservoir. These methods prevent the pressurized ink within the ink reservoir from flowing out the ink inlet through closure of the ink inlet by the inlet seal.

The shaft is adapted to move to a first position when biased in the first direction, and to a second position when biased in the second direction. Positioning the shaft in the first position locates the inlet seal to not seal the ink inlet and simultaneously positions the outlet seal to seal the ink outlet. However, positioning the shaft in the second position locates the inlet seal to seal the ink inlet and simultaneously positions the outlet seal to not seal the ink outlet, thus allowing the pressurized ink out from the ink reservoir.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, improvements to the valves utilized with melter devices would be advantageous. In view of this, apparatuses and methods herein combine multiple valves utilized with the melter into a single valve structure to form a pneumatically driven integrated piston and multiple shut-off valve structure. Such an integrated multi-valve structure requires fewer moving parts, reduces cost, and simplifies controls/software implementation, etc.

More specifically, the apparatuses and methods herein provide a dual-purpose pneumatic multi-valve structure that can be used to simultaneously control both the inlet and the outlet of the melter tank. This customized valve structure also enables use of a filter with a large surface area within the ink path, in series with the two shut-off points. A large filter surface area is desirable for longer filter life and ensures that contaminates do not enter into the printhead and clog the jets.

In this design, a monolithic shaft is machined to create a piston and valve stem. The piston is spring loaded in the "closed" position, where ink is allowed to flow into the melter tank but prevented from flowing out of the melter tank into the printhead. Air pressure supplied on the reverse side of the piston overcomes the bias of the spring and forces the shaft to move to the "open" position, where ink is allowed to flow into the printhead, but prevented from flowing into the melter tank.

The valve stem has several O-rings to provide seals. For example, starting at the top of the stem, the inlet seal closes off the melter reservoir inlet to allow the reservoir to be pressurized to force ink into the printhead. Moving down the valve stem, the cylinder seal prevents ink from leaking down the valve cylinder and bypassing the filter. Next, the outlet seal prevents ink from flowing into printhead (when printhead is full), and also prevents return of backpressure from the printhead when the printhead is purged. The chamber seal is used to prevent ink from leaking down into the piston chamber. Finally, the piston seal prevents air leaks from occurring around the piston. While some seals are shown in the following examples, other seals and chambers could be included as needed for specific implementations.

Thus, the apparatuses and methods herein provide a pressurized and heated ink reservoir tank with a single pneumatic structure simultaneously controlling two shut-off points that enables the use of a large in-series filter. Such apparatuses and methods positively shut off ink flow into the printhead, positively prevent backpressure from the printhead reaching the ink reservoir, positively shut off ink flow from the melter device into the ink reservoir, and positively seal the melter reservoir so it can be pressurized to supply pressurized ink to the printhead.

Figure 1:
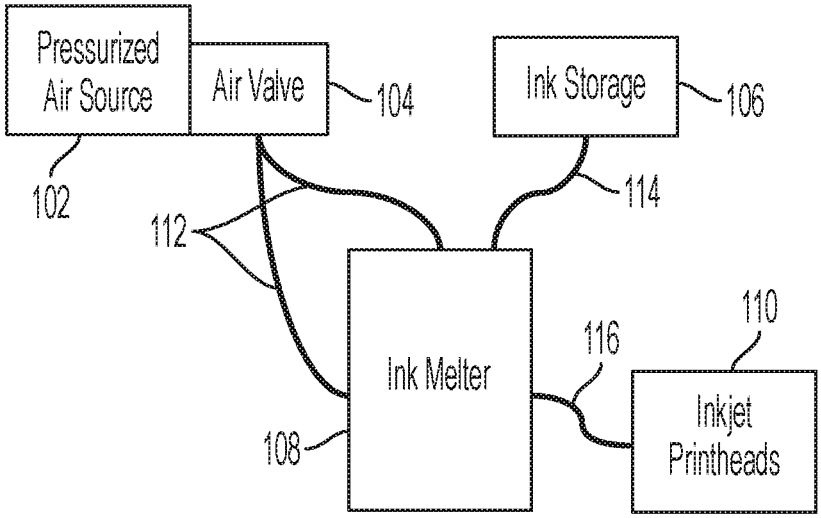
FIG. 1 is a schematic diagram illustrating aspects of printing devices herein.
Figure 2A:
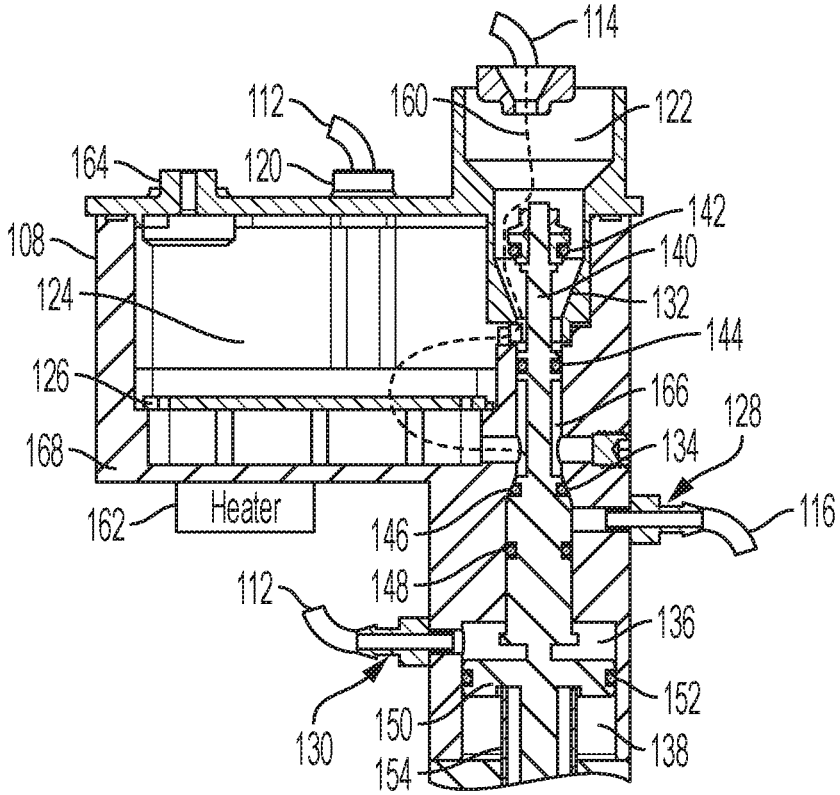
FIGS. 2A-2B are schematic diagrams illustrating an exemplary melter device herein.
Figure 2B:
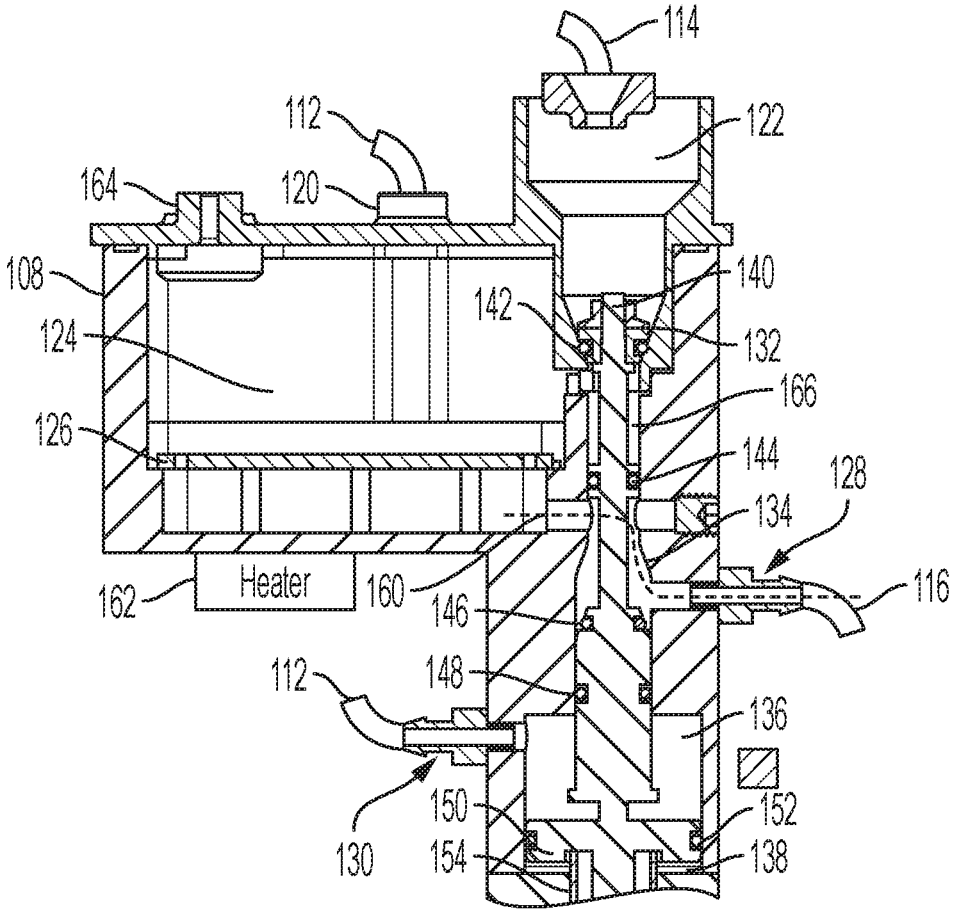
Figure 3:
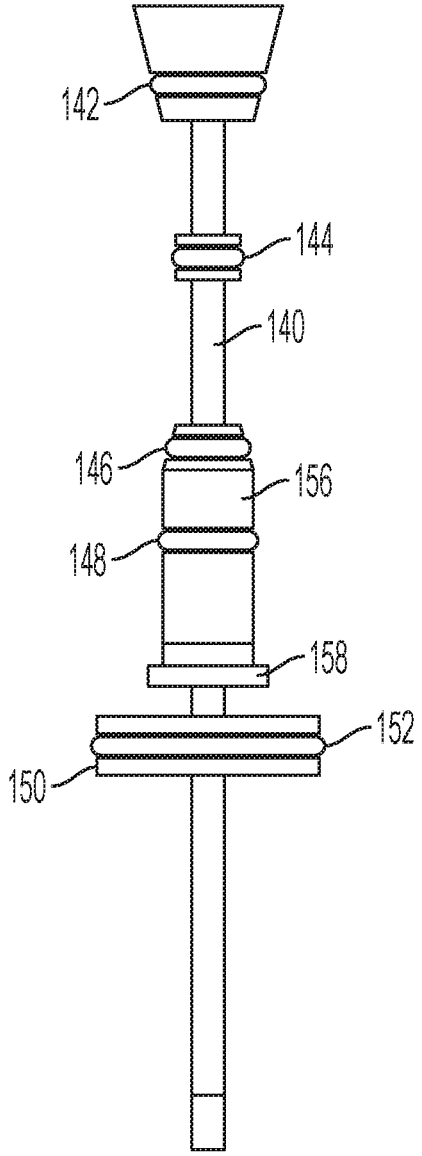
FIG. 3 is a schematic diagram of a shaft and seals of a combined integrated multi-valve structure used by devices herein.

Some specific examples of the pressurized/heated ink delivery apparatuses herein (generically referred to as an "ink melter" device 108) are shown in FIGS. 1-3. Specifically, as shown in FIG. 1, the ink melter device 108 is connected to a pressurized air source 102 through pressurized air lines 112. As is understood by those ordinarily skilled in the art, the pressurized air source 102 can include various air filters, air pumps, fans, etc., used to output air that is at a pressure greater than atmospheric pressure, and is potentially at pressure that is a number of times greater than atmospheric pressure (e.g., 20-1000 psi or higher). Note that the pressurized air source 102 can be connected to, or can include, an air valve 104 that can control release of the pressurized air to the pressurized air lines 112.

Additionally, the ink melter device 108 receives liquid, solid, or semi-solid ink from an ink storage 106 through an ink delivery line 114 (which can be gravity-fed, pressure-fed, auger-fed, etc.). The ink melter 108 supplies pressurized (and potentially heated) liquid ink to the inkjet printheads 110 through a pressurized liquid ink delivery line 116.

As shown in FIG. 2A, the ink melter 108 includes an internal ink reservoir 124 (which is an airtight tank capable of being heated and pressurized), an ink inlet 122 positioned to allow ink to flow from the ink storage vessel 106 into the internal ink reservoir 124, an ink outlet 128 positioned to allow ink to flow from the internal ink reservoir 124 out to inkjet printheads 110, and various unlabeled internal passages that place devices in fluid communication (e.g., the internal passages allow fluid/air to internally flow within the ink melter device 108 between the various inlets, outlets, and chambers). A reservoir air inlet 120 is positioned to allow pressurized air to flow into the internal ink reservoir 124, and the pressurized air pressurizes ink in the ink reservoir 124.

Also, a pneumatic integrated multi-valve structure 140-154 is positioned within the ink inlet 122 and the ink outlet 128, which open/closes (seals/unseals) both the ink inlet 122 and the ink outlet 128. The multi-valve structure 140-154 is also positioned in a cylinder 136, 138. A cylinder air inlet 130 is positioned to allow pressurized air to flow into a first portion 136 of the cylinder, and a biasing member 154 is within a second portion 138 of the cylinder.

In greater detail, the pneumatic integrated multi-valve structure 140-154 has a shaft 140, an inlet seal 142 connected to the shaft 140, an outlet seal 146 connected to the shaft 140, and a piston 150 connected to the shaft 140. The inlet seal 142, the outlet seal 146, and the piston 150 are connected to the shaft 140 (as individual components connected to the shaft 140, or all as part of a solid, single material, unitary, monolithic structure) and therefore all such components simultaneously move together with the shaft 140. In other words, components 142, 144, 146, 150, etc., are rigidly fixed to (or are part of) the shaft 140, and such components do not move along the shaft 140. The inlet seal 142, the outlet seal 146, and the piston 150 are aligned relative to (along, in line with, etc.) the centerline of the shaft 140. A piston seal 152 seals the space between the piston 150 and the cylinder 136, 138.

More specifically, the internal ink reservoir 124 and the cylinder 136, 138 are separate cavities within a solid, continuous body 168. For example, the body 168 can comprise a metal structure, plastic structure, ceramic structure, glass structure, etc. Additionally, the body 168 can be formed through molding processes, milling of monolithic structures, assembly from different components, etc.

The body 168 also has a linear (cylindrical) shaft cavity 166 in which the shaft 140 is located. A first end of the linear shaft cavity 166 is in internal fluid/air communication with the ink inlet 122 and the internal ink reservoir 124. A second end of the linear shaft cavity 166 is in internal fluid/air communication with the ink outlet 128 and internal ink reservoir 124. The integrated multi-valve structure 140-154 has a shaft cavity seal 144 between the first end of the linear shaft cavity 166 and the second end of the linear shaft cavity 166, preventing fluid from passing through the linear shaft cavity 166 between the first end and the second end.

Other elements in FIG. 2A include a heater 162 and a manual fill/cleanout access location/cap 164. FIG. 2A additionally shows that the body 168 includes tapered, curved, cylindrical, conical, etc., surfaces 132, 134 against which the inlet seal 142 and the outlet seal 146 respectively contact/press to seal the ink inlet 122 and ink outlet 128. A secondary shaft seal 148 provides additional sealing for the shaft 140 within the lower portions of the shaft cavity 166.

FIG. 2A illustrates the pneumatic integrated multi-valve structure 140-154 in what is arbitrarily referred to herein as the upward or top position (which is generically referred to herein as the "first" position). The integrated multi-valve structure 140-154 is positioned in the first position when the air valve 104 is closed and pressurized air is not supplied to the reservoir air inlet 120 or the cylinder air inlet 130, which allows the force supplied by the biasing member 154 to dominate the action/position of the piston 150, and as a result determine the position of the entire integrated multi-valve structure 140-154.

While the terms upward, downward, top, bottom, etc., are used to reference the orientation shown in the drawings, those ordinarily skilled in the art would understand that the structures shown can be oriented in any direction and such terms are merely used as shorthand terms to more easily reference the arbitrary orientation of the views shown in the attached drawings.

When in this first (top) position, the biasing member 154 contacts and pushes against the piston 150 and thereby biases the piston 150 in the upward or first direction. When in this first position, the inlet seal 142 is separated from the conical surface 132 of the body 168 providing a gap between the inlet seal 142 and the conical surface 132, thereby "opening" the inlet seal 142. Simultaneously, when in the first position the outlet seal 146 rests firmly against the curved/conical surface 134 of the body 168, thereby creating a seal which blocks or closes the passage between the internal ink reservoir 124 and the ink outlet 128 (thereby "closing" the outlet seal 146).

Thus, in the first position, the pneumatic integrated multi-valve structure 140-154 provides an ink flow path 160 (shown using broken lines in FIG. 2A) through and past the open inlet seal 142 into the upper portion of the internal ink reservoir 124, through the filter 126 and into the bottom portion of the internal ink reservoir 124 on the opposite side of the filter 126. However, because the outlet seal 146 is in contact with the correspondingly curved/conical portion of the body 134, the outlet seal 146 is closed, which prevents the fluid ink from passing to the ink outlet 128.

FIG. 2B illustrates the pneumatic integrated multi-valve structure 140-154 in the downward or bottom position (which is arbitrarily generically referred to herein as the "second" position, and again all positions merely make shorthand reference to the arbitrary orientation shown in the drawings). The integrated multi-valve structure 140-154 is positioned in the second position when the air valve 104 is open and pressurized air is simultaneously supplied to the reservoir air inlet 120 and the cylinder air inlet 130. This pressurized air in the first portion 136 of the cylinder biases the piston 150 in a second direction (opposite the first direction) by overcoming the biasing force applied by the biasing member 154. The reservoir air inlet 120 and the cylinder air inlet 130 are connected to the same air pressure source 102 and receive the pressurized air simultaneously.

In the second position, the pneumatic integrated multi-valve structure 140-154 provides an ink flow path 160 (shown using broken lines in FIG. 2B) from the now-pressurized internal ink reservoir 124, through and past the open outlet seal 128 into the liquid ink line 116 and eventually to the ink jet printheads 110. However, because the inlet seal 142 is in contact with the correspondingly curved portion of the body 132, the inlet seal 142 is closed, which prevents the fluid ink from flowing from the internal ink reservoir 124 back through the ink inlet 122.

Thus, as shown, the multi-valve structure 140-154 is adapted to move in the first direction within the cavity 166 to the first position when biased only by the biasing member 154 (FIG. 2A), and move in the second direction to the second position when biased by the pressurized air (FIG. 2B). Positioning the multi-valve structure 140-154 in the first position locates the inlet seal 142 to not seal the ink inlet 122 and positions the outlet seal 146 to seal the ink outlet 128. This shuts off ink flow into the printhead 110 and positively prevents backpressure from the printhead 110 reaching the ink reservoir 124.

In contrast, positioning the multi-valve structure 140-154 in the second position locates the inlet seal 142 to seal ("close") the ink inlet 122 and positions the outlet seal 146 to not seal ("open") the ink outlet 128. Closure of the ink inlet 122 by the inlet seal 142 prevents pressurized ink within internal ink reservoir 124 from flowing out the ink inlet 122. This positively shuts off ink flow from the melter device 108 into the ink storage 106, and positively seals the internal ink reservoir 124 so it can be pressurized to supply pressurized ink to the printhead 110.

FIG. 3 is a schematic diagram of just the pneumatic integrated multi-valve structure 140-154. As noted above, FIG. 3 shows the shaft 140, the inlet seal 142 connected to (or part of) the shaft 140, the shaft cavity seal 144 connected to (or part of) the shaft 140, the outlet seal 146 and secondary shaft seal 148 on a domed surface 156 connected to (or part of) the shaft 140, the piston 150 connected to (or part of) the shaft 140, and piston seal 152 on the piston 150.

In the examples shown in FIGS. 2A-3 the inlet seal 142 includes a rigid conical surface and a flexible O-ring maintained within groove in the conical surface. All O-rings described herein comprise a flexible durable material such as rubber, polyurethane, plastics, soft metals, etc. Note that the cavity 132 in the body 168 has a matching corresponding shape to the conical surface of the inlet seal 142, which allows the outer conical surface of the inlet seal 142 to fit tightly against the inner conical surface of the cavity 132, and which compresses the O-ring forming a liquid- and air-tight seal.

FIGS. 2A-3 show that the shaft cavity seal 144 includes a rigid disk-shaped surface and a flexible O-ring maintained within a groove in the disk-shaped surface. Note that the cavity 166 in the body 168 has a matching corresponding shape to the disk-shaped of the shaft cavity seal 144 (e.g., cylindrical) which allows the outer rounded surface of the shaft cavity seal 144 to fit tightly against the inner rounded surface of the cavity 166, and which compresses the O-ring, thereby forming a liquid- and air-tight seal. However, note that the tightness (controlled by the size of the components) of the seal formed by the O-ring is limited to allow the shaft cavity seal 144 to freely move within the cavity 166.

Additionally, FIGS. 2A-3 show that the outlet seal 146 and secondary shaft seal 148 are flexible O-rings maintained within grooves in the domed surface 156 (which is partially domed and partially cylindrical). Note that an area of the cavity 166 in the body 168 has a matching corresponding shape to the partially domed and partially cylindrical shape of the domed surface 156, which allows the outer rounded surface of the outlet seal 146 and secondary shaft seal 148 to fit tightly against the inner rounded partially domed and partially cylindrical shape of the cavity 166, and which compresses the O-rings forming a liquid- and air-tight seal.

Note that FIGS. 2A-3 illustrate that the domed surface 156 can include a disk-shaped flange 158. The flange 158 is sized to fit within the upper portion of the cylinder 136 but is too large to fit within the cylindrical shape of the cavity 166 (see FIGS. 2A-2B), which limits the movement of integrated multi-valve structure 140-154 in the first direction. Therefore, when the flange 158 is pushed against the end (top) of the upper portion of the cylinder 136 by the biasing member 154, the integrated multi-valve structure 140-154 is in the first position. In contrast, when the surface of the piston 150 fully compresses the biasing member 154 (as a result of pressurized air within the upper portion of the cylinder 136), the integrated multi-valve structure 140-154 is in the second position.

Further, FIGS. 2A-3 show that the piston 150 includes a rigid disk-shaped surface and a flexible O-ring 152 maintained within a groove in the disk-shaped surface. Note that the cylinder 136, 138 has a matching corresponding shape to the disk-shaped of the piston 150 (e.g., cylindrical) which allows the outer rounded surface of the piston to fit tightly against the inner rounded surface of the cylinder 136, 138, and which compresses the O-ring 152, thereby forming a liquid- and air-tight seal. However, note that the tightness of the seal formed by the O-ring 152 is limited to allow the piston 150 to freely move within the cylinder 136, 138.

While some specific exemplary shapes and devices are presented in the drawings and description of the drawings, the various seals and valves described herein could take any form of seal/valve that is currently known or developed in the future. Therefore, these embodiments are not limited to the specific seals/valves illustrated and described but are intended to include all equivalent thereof.

Figure 4:
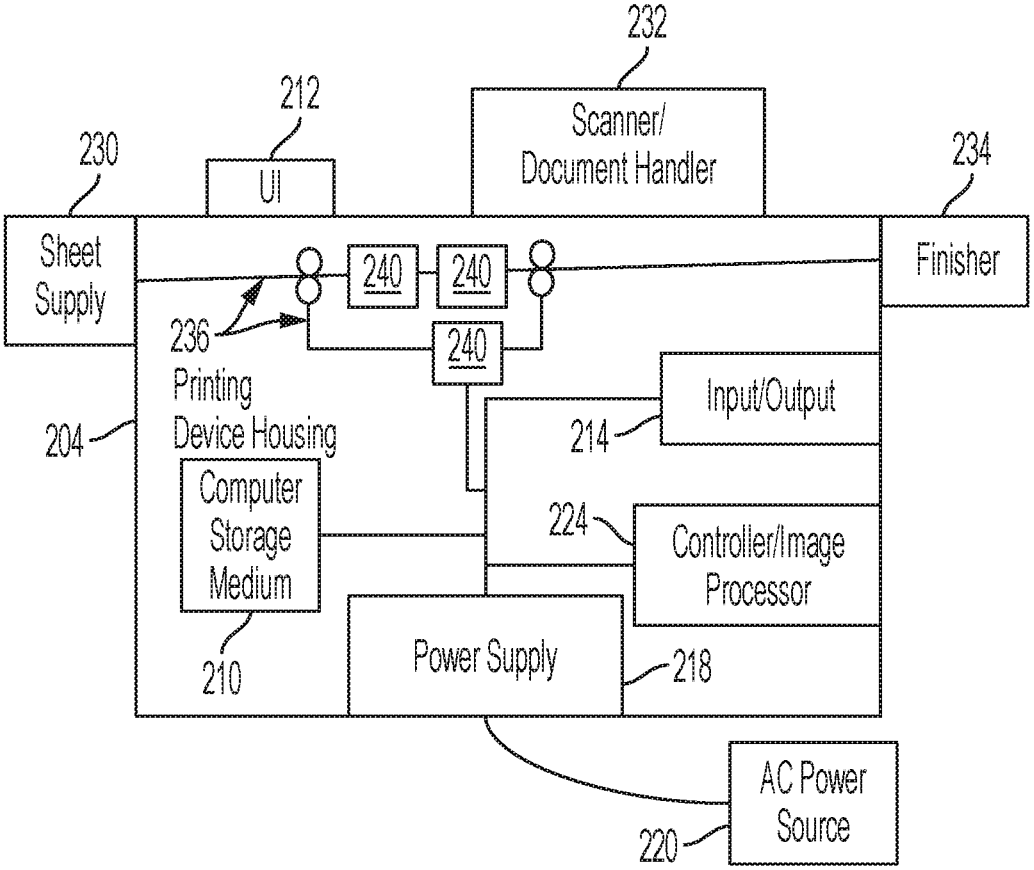
FIG. 4 is a schematic diagram of a printing device using the melter device shown in FIGS. 2A-2B.

FIG. 4 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a user interface (UI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 4, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that include the above described melter device 108, use marking material, and are operatively connected to a specialized image processor 224 (that is different from a general purpose computer because it is specialized for processing image data), a media path 236 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 240 can include, for example, devices that use electrostatic toner printers, inkjet printheads, contact printheads, three-dimensional printers, etc. The one or more printing engines 240 can include, for example, devices that use a photoreceptor belt or an intermediate transfer belt or devices that print directly to print media (e.g., inkjet printers, ribbon-based contact printers, etc.).

In one example, the processor 224 controls the air valve 104 to close when the ink level sensor within the printheads 110 indicates that ink is not needed by the printheads 110 or when an ink purging operation is being performed by the printheads 110. Closing the air valve 104 in this manner simultaneously causes the internal ink reservoir 124 to be unpressurized (because pressurized air is not supplied to the air inlet 120) and also the biasing member 154 to move the integrated multi-valve structure 140-154 into the first position, which simultaneously opens the ink inlet valve 142 and closes the ink outlet valve 146. As noted above, when in the first position, the integrated multi-valve structure 140-154 allows ink to flow into the internal ink reservoir 124 from the ink storage 106 but prevents ink from flowing from the internal ink reservoir 124 into the inkjet printheads 110.

In another example, the processor 224 controls the air valve 104 to open when the ink level sensor within the printheads 110 indicates that ink is needed by the printheads 110. Opening the air valve 104 in this manner simultaneously causes the internal ink reservoir 124 to be pressurized (because pressurized air is supplied to the air inlet 120) and also supplies pressurized air to the top of the cylinder 136 to move the integrated multi-valve structure 140-154 into the second position, which simultaneously closes the ink inlet valve 142 and opens the ink outlet valve 146. As noted above, when in the second position, the integrated multi-valve structure 140-154 prevents ink backflow from the internal ink reservoir 124 back to the ink storage 106 but allows pressurized ink to flow from the internal ink reservoir 124 to the inkjet printheads 110.

Figure 5:
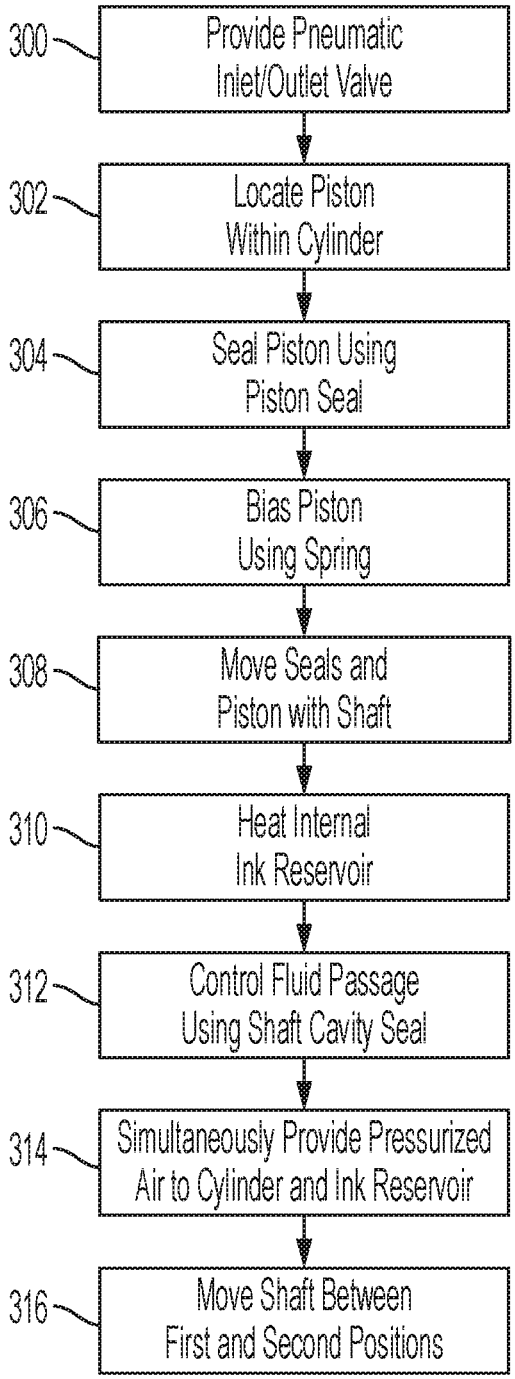
FIG. 5 is a flow diagram of various methods herein.

FIG. 5 is a flowchart illustrating exemplary methods of delivering pressurized ink that are permitted by the foregoing structures. In the flowchart shown in FIG. 5, the steps do not need to be performed sequentially, but can occur in any order.

Specifically, as shown in item 300, such methods can provide the pneumatic integrated multi-valve structure described (e.g., provide a shaft, an inlet seal connected to the shaft, an outlet seal connected to the shaft, a piston connected to the shaft, etc.). In item 300, the inlet seal, the outlet seal, the piston, etc., are positioned to be aligned relative to a centerline of the shaft. As noted above, the inlet seal seals an ink inlet that is in fluid communication with an ink reservoir. The outlet seal seals an ink outlet that is in fluid communication with the ink reservoir.

In item 302, such methods locate the piston within a cylinder. These methods also seal the space between the piston and the cylinder using a piston seal in item 304. In item 306, these methods also contact a biasing member (e.g., a spring, elastic band, magnet, etc.) against the piston to bias the piston in a first direction. In item 308, methods herein simultaneously move the inlet seal, the outlet seal, and the piston (that are connected to the shaft) with the shaft. Also, these methods heat the internal ink reservoir using a heater in item 310.

As described above, the shaft is within a body. The ink reservoir and the cylinder are separate cavities within the body. The body has a linear shaft cavity in which the shaft is located. A first end of the linear shaft cavity is in fluid/air communication (e.g., through internal passages) with the ink inlet and the ink reservoir. A second end of the linear shaft cavity is in fluid communication with the ink outlet and ink reservoir. As shown in item 312, the methods herein control ink flow and prevent fluid from passing through the linear shaft cavity between the first end and the second end using a shaft cavity seal between the first end of the linear shaft cavity and the second end of the linear shaft cavity.

Further, in item 314 such methods simultaneously provide pressurized air to the cylinder and to the ink reservoir to bias the piston in a second direction, opposite the first direction, and to pressurize ink within the ink reservoir. In item 314, these methods prevent the pressurized ink within the ink reservoir from flowing out the ink inlet through closure of the ink inlet by the inlet seal.

As shown in item 316, these methods move the shaft to a first position when biased in the first direction, and to a second position when biased in the second direction. Positioning the shaft in the first position simultaneously locates the inlet seal to not seal the ink inlet and positions the outlet seal to seal the ink outlet. However, positioning the shaft in the second position simultaneously locates the inlet seal to seal the ink inlet and positions the outlet seal to not seal the ink outlet, thus allowing the pressurized ink out from the ink reservoir.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A pneumatic integrated structure comprising:
an internal ink reservoir;
a reservoir air inlet positioned to allow pressurized air to flow into the internal ink reservoir;
a cylinder adjacent the internal ink reservoir;
a shaft within the cylinder;
an inlet seal connected to the shaft;
an outlet seal connected to the shaft; and
a piston connected to the shaft,
wherein the piston is within the cylinder,
wherein the inlet seal, the outlet seal, and the piston are connected to the shaft and move with the shaft,
wherein a biasing member contacts the piston and biases the piston in a first direction, and the pressurized air in the cylinder biases the piston in a second direction, opposite the first direction,
wherein the shaft is adapted to move to a first position when biased in the first direction, and to a second position when biased in the second direction,
wherein positioning the shaft in the first position simultaneously locates the inlet seal to not seal an ink inlet in fluid communication with the internal ink reservoir and positions the outlet seal to seal an ink outlet,
wherein positioning the shaft in the second position simultaneously locates the inlet seal to seal the ink inlet and positions the outlet seal to not seal the ink outlet, and
wherein the ink inlet and the ink outlet are in fluid communication with the internal ink reservoir.

2. The pneumatic integrated structure according to claim 1, wherein the internal ink reservoir and the cylinder are connected to the same air pressure source and receive the pressurized air simultaneously, wherein the pressurized air pressurizes ink in the internal ink reservoir.

3. The pneumatic integrated structure according to claim 1, wherein the inlet seal, the outlet seal, and the piston are aligned relative to a centerline of the shaft.

4. The pneumatic integrated structure according to claim 1, wherein the shaft is within a body,
wherein the internal ink reservoir and the cylinder comprise separate cavities within the body,
wherein the body comprises a linear shaft cavity in which the shaft is located,
wherein a first end of the linear shaft cavity is in fluid communication with the ink inlet and the internal ink reservoir,
wherein a second end of the linear shaft cavity is in fluid communication with the ink outlet and internal ink reservoir, and
wherein the pneumatic integrated structure further comprises a shaft cavity seal between the first end of the linear shaft cavity and the second end of the linear shaft cavity preventing fluid from passing through the linear shaft cavity between the first end and the second end.

5. The pneumatic integrated structure according to claim 1, wherein closure of the ink inlet by the inlet seal prevents pressurized ink within the ink internal reservoir from flowing out the ink inlet.

6. The pneumatic integrated structure according to claim 1, further comprising a piston seal between the piston and the cylinder.

7. The pneumatic integrated structure according to claim 1, further comprising a heater positioned to heat the internal ink reservoir.

8. A pressurized ink delivery apparatus comprising:
an internal ink reservoir;
an ink inlet positioned to allow ink to flow from an ink storage vessel into the internal ink reservoir;
an ink outlet positioned to allow ink to flow from the internal ink reservoir out to inkjet printheads;
a reservoir air inlet positioned to allow pressurized air to flow into the internal ink reservoir;
a pneumatic integrated multi-valve structure positioned within the ink inlet and the ink outlet;
a cylinder in which the pneumatic integrated multi-valve structure is positioned;
a cylinder air inlet positioned to allow pressurized air to flow into a first portion of the cylinder; and
a biasing member within a second portion of the cylinder,
wherein the pneumatic integrated multi-valve structure comprises a shaft, an inlet seal connected to the shaft, an outlet seal connected to the shaft, and a piston connected to the shaft,
wherein the inlet seal, the outlet seal, and the piston are connected to the shaft and move with the shaft,
wherein the biasing member contacts the piston and biases the piston in a first direction, and pressurized air in the first portion of the cylinder biases the piston in a second direction, opposite the first direction,
wherein the shaft is adapted to move to a first position when biased in the first direction, and to a second position when biased in the second direction,
wherein positioning the shaft in the first position simultaneously locates the inlet seal to not seal the ink inlet and positions the outlet seal to seal the ink outlet, and
wherein positioning the shaft in the second position simultaneously locates the inlet seal to seal the ink inlet and positions the outlet seal to not seal the ink outlet.

9. The pressurized ink delivery apparatus according to claim 8, wherein the reservoir air inlet and the cylinder air inlet are connected to the same air pressure source and receive the pressurized air simultaneously, wherein the pressurized air pressurizes ink in the internal ink reservoir.

10. The pressurized ink delivery apparatus according to claim 8, wherein the inlet seal, the outlet seal, and the piston are aligned relative to a centerline of the shaft.

11. The pressurized ink delivery apparatus according to claim 8, further comprising a body,
wherein the internal ink reservoir and the cylinder comprise separate cavities within the body,
wherein the body comprises a linear shaft cavity in which the shaft is located,
wherein a first end of the linear shaft cavity is in fluid communication with the ink inlet and the internal ink reservoir, wherein a second end of the linear shaft cavity is in fluid communication with the ink outlet and internal ink reservoir, and wherein the pneumatic integrated multi-valve structure further comprises a shaft cavity seal between the first end of the linear shaft cavity and the second end of the linear shaft cavity preventing fluid from passing through the linear shaft cavity between the first end and the second end.

12. The pressurized ink delivery apparatus according to claim 8, wherein closure of the ink inlet by the inlet seal prevents pressurized ink within internal ink reservoir from flowing out the ink inlet.

13. The pressurized ink delivery apparatus according to claim 8, further comprising a piston seal between the piston and the cylinder.

14. The pressurized ink delivery apparatus according to claim 8, further comprising a heater positioned to heat the internal ink reservoir.

15. A pressurized ink delivery apparatus comprising:

an internal ink reservoir;

an ink inlet positioned to allow ink to flow from an ink storage vessel into the internal ink reservoir;

an ink outlet positioned to allow ink to flow from the internal ink reservoir;

a reservoir air inlet positioned to allow pressurized air to flow into the internal ink reservoir;

a pneumatic integrated multi-valve structure positioned within the ink inlet and the ink outlet;

a cylinder in which the pneumatic integrated multi-valve structure is positioned; and at least one biasing member within the cylinder, wherein the pneumatic integrated multi-valve structure comprises a shaft, an inlet seal connected to the shaft, and an outlet seal connected to the shaft, wherein the inlet seal and the outlet seal are connected to the shaft and move with the shaft, wherein the at least one biasing member biases the shaft between a first direction and a second direction, opposite the first direction, wherein the shaft is adapted to move to a first position when biased in the first direction, and to a second position when biased in the second direction, wherein positioning the shaft in the first position simultaneously locates the inlet seal to not seal the ink inlet and positions the outlet seal to seal the ink outlet, and wherein positioning the shaft in the second position simultaneously locates the inlet seal to seal the ink inlet and positions the outlet seal to not seal the ink outlet.

16. The pressurized ink delivery apparatus according to claim 15, wherein the reservoir air inlet is connected to an air pressure source, wherein the pressurized air pressurizes ink in the internal ink reservoir.

17. The pressurized ink delivery apparatus according to claim 15, wherein the inlet seal and the outlet seal are aligned relative to a centerline of the shaft.

18. The pressurized ink delivery apparatus according to claim 15, further comprising a body, wherein the internal ink reservoir and the cylinder comprise separate cavities within the body, wherein the body comprises a linear shaft cavity in which the shaft is located, wherein a first end of the linear shaft cavity is in fluid communication with the ink inlet and the internal ink reservoir, wherein a second end of the linear shaft cavity is in fluid communication with the ink outlet and internal ink reservoir, and wherein the pneumatic integrated multi-valve structure further comprises a shaft cavity seal between the first end of the linear shaft cavity and the second end of the linear shaft cavity preventing fluid from passing through the linear shaft cavity between the first end and the second end.

19. The pressurized ink delivery apparatus according to claim 15, wherein closure of the ink inlet by the inlet seal prevents pressurized ink within internal ink reservoir from flowing out the ink inlet.

20. The pressurized ink delivery apparatus according to claim 15, further comprising a heater positioned to heat the internal ink reservoir.

* * * * *